United States Patent [19]

El-Kaddah et al.

[11] Patent Number: 5,033,948

[45] Date of Patent: Jul. 23, 1991

[54] INDUCTION MELTING OF METALS WITHOUT A CRUCIBLE

[75] Inventors: Nagy H. El-Kaddah; Thomas S. Piwonka, both of Tuscaloosa; John T. Berry, Northport, all of Ala.

[73] Assignee: Sandvik Limited, West Midlands, England

[21] Appl. No.: 505,400

[22] Filed: Apr. 6, 1990

Related U.S. Application Data

[63] Continuation-in-part of Ser. No. 339,271, Apr. 17, 1989.

[51] Int. Cl.[5] ..... B22D 23/00; B22D 45/00; B22F 9/10; H05B 6/36

[52] U.S. Cl. ..... 425/8; 164/493; 164/513; 219/10.43; 219/10.491; 219/10.79; 264/8; 373/139; 425/174.8 R

[58] Field of Search ..... 164/493, 513, 471, 507; 373/137, 138, 139, 140; 219/10.43, 10.491, 10.67, 10.75, 10.79; 425/8, 174.8 R; 264/8

[56] References Cited

U.S. PATENT DOCUMENTS

| | | | |
|---|---|---|---|
| 2,495,193 | 1/1950 | Wells | 219/10.67 X |
| 2,537,289 | 1/1951 | van Embden | 219/10.491 X |
| 2,686,865 | 8/1954 | Kelly, Jr. | 219/10.79 X |
| 2,957,064 | 10/1960 | Comenetz | 219/10.67 X |
| 3,100,250 | 8/1963 | Herczog et al. | 219/10.491 |
| 3,163,523 | 12/1964 | Porter et al. | 164/493 X |
| 3,310,384 | 3/1967 | Keller | 373/139 X |
| 3,351,686 | 11/1967 | Gayet et al. | 219/10.43 X |

FOREIGN PATENT DOCUMENTS

| | | | |
|---|---|---|---|
| 61-216845 | 9/1986 | Japan | 164/493 |
| 1412627 | 11/1975 | United Kingdom | 164/493 |

*Primary Examiner*—Richard K. Seidel
*Assistant Examiner*—J. Reed Batten, Jr.
*Attorney, Agent, or Firm*—Burns, Doane, Swecker & Mathis

[57] ABSTRACT

The solid metal to be melted is placed on a support, within an induction coil which is adapted to provide a greater electromagnetic force towards the lower portion of the quantity of metal. When energy is provided to the coil, the metal melts from the top downward, but the concentration of electromagnetic force towards the bottom of the metal causes the liquid metal to retain a cylindrical shape. When most of the metal is melted, the liquid metal passes through an opening in the support. In a preferred embodiment, the coil is movable relative to the quantity of metal, and at the beginning of the melting process only the top portion of the quantity of metal is disposed within the coil. As the quantity of metal melts, the coil is moved downward. The method may also be used for removing impurities from the quantity of metal.

12 Claims, 3 Drawing Sheets

INDUCTION MELTING OF METALS WITHOUT A CRUCIBLE

CROSS-REFERENCE TO RELATED APPLICATION

This application is a continuation-in-part of application Ser. No. 07/339,271, filed Apr. 17, 1989.

FIELD OF THE INVENTION

This invention relates to the induction melting of a quantity of metal without the need for a crucible or other container. Instead, a magnetic field is used to contain the melt.

BACKGROUND OF THE INVENTION

In the manufacture of metal castings it is important to avoid contamination of the metal with non-metallic inclusions. These inclusions are usually oxide phases, and are usually formed by reaction between the metals being melted and the crucible in which they are melted. It has long been an aim of metal casters to avoid such contamination by using crucibles which have minimum reactivity with the melts. However, some alloys, in particular nickel-based superalloys, which may contain substantial amounts of aluminum, titanium, or hafnium, react vigorously with oxide crucibles and form inclusions during melting.

In the case of titanium-base alloys and alloys of refractory metals (tungsten, tantalum, molybdenum, niobium, hafnium, rhenium, and zirconium), crucible melting is virtually impossible because of the violence of reactions with the crucible. So a related aim of metalcasters is to find a way to melt these alloys without contamination.

Heretofore there have been two main methods of avoiding contamination from a crucible in metal smelting. One method is "cold-crucible" melting, in which a water cooled copper crucible is used. The metal charge, which may be melted by induction, electric arc, plasma torch, or electron beam energy sources, freezes against the cold copper crucible wall. Thereafter, the liquid metal is held within a "skull" of solid metal of its own composition, instead of coming in contact with the crucible wall.

Another method is levitation melting. In levitation melting, a quantity of metal to be melted is electromagnetically suspended in space while it is heated. U.S. Pat. Nos. 2,686,864 to Wroughton et al. and 4,578,552 to Mortimer show methods of using induction coils to levitate a quantity of metal and heat it inductively.

Cold crucible melting and levitation melting necessarily consume a great deal of energy. In the case of cold-crucible melting, a substantial amount of energy is required merely to maintain the pool of molten metal within the skull, and much of the heating energy put into the metal must be removed deliberately just to maintain the solid outer portion. With levitation melting, energy is required to keep the metal suspended. In addition, as compared to the surface of a molten bath in a conventional crucible, levitation melting causes the quantity of metal to have a large surface area, which is a source of heat loss by radiation. Additional energy is required to maintain the metal temperature.

For alloys which are mildly reactive with crucibles, such as the nickel-base superalloys referred to above, a process called the "Birlec" process has been used. This process was developed by the Birmingham Electric Company in Great Britain. In the Birlec process, induction is used to melt just enough metal to pour one casting. Instead of pouring metal from the crucible conventionally, however, by tilting it and allowing the melt to flow over its lip, the crucible has an opening in its bottom covered with a "penny" or "button" of charge metal. After the charge is melted, heat transfer from the molten charge to the penny melts the penny, allowing the molten metal to fall through the opening into a waiting casting mold below.

By using a small quantity of metal with the proper induction melting frequency and power in the Birlec process, the metal can be "haystacked," or partially levitated, and held away from the crucible sides for much of the melting process, thus minimizing, although not eliminating, contact with the crucible sidewall. Such a process is in use today for the production of single crystal investment castings for the gas turbine industry. See, "From Research To Cost-Effective Directional Solidification And Single-Crystal Production--An Integrated Approach," by G. J. S. Higginbotham, *Materials Science and Technology*, Vol. 2, May, 1986, pp. 442–460.

The use of "haystacking" to melt refractory and titanium alloys was tried by the U.S. Army at Watertown Arsenal in the 1950s, using carbon crucibles. See, J. Zotos, P. J. Ahearn and H. M. Green, "Ductile High Strength Titanium Castings By Induction Melting", *American Foundrymen's Society Transactions*, Vol. 66, 1958, 225–230. An attempt was made to improve on their results in the 1970s by combining the haystacking process with the Birlec process. See, T. S. Piwonka and C. R. Cook, "Induction Melting and Casting of Titanium Alloy Aircraft Components," Report AFFL-TR-72-168, 1972, Air Force Systems Command, Wright-Patterson AFB, Ohio. Neither of these attempts was successful in eliminating carbon contamination from the crucible, and there was no satisfactory method of controlling the pouring temperature of the metal to the accuracy desired for aerospace work.

In short, there has heretofore been no efficient way to melt and control pouring temperature which avoids crucible contamination. A need exists for such a way, particularly for highly reactive metals such as refractory metals and their alloys and titanium and its alloys, and for moderately reactive alloys such as nickel-based super-alloys and stainless steels.

SUMMARY OF THE INVENTION

The invention is an apparatus and method for inductively melting a quantity of metal without a container. The quantity of metal, or "charge", is placed within an induction coil, which exerts on the metal an electromagnetic force which increases toward the bottom portion of the charge. The charge is free-standing on a support. The support has an opening therethrough, and further includes means for maintaining the support at a preselected temperature.

In a preferred embodiment of the invention, the induction coil is movable relative to the metal charge. At the beginning of the melting process, the coil is positioned so that only a portion of the metal charge is disposed within the coil, and this portion of the charge is inductively heated to a preselected temperature. Then the coil is lowered to encompass substantially all of the metal charge so that all of the metal charge may be heated.

In another preferred embodiment of the invention, at least the topmost of the turns of the coil are wound in a direction opposite that of the other turns, so as to prevent levitation of the metal charge as it melts. After the metal charge is melted by the induction coil, the liquid metal passes through the opening in the support into either a casting mold having an inlet opening in communication with the opening in the support, or alternatively onto a rotatable disk adjacent to the opening in the support.

In another preferred embodiment of the invention, the volume for receiving the metal charge is enveloped by a sealed chamber having means for controlling the atmosphere therein.

The method comprises the steps of placing the quantity of metal within the induction coil, and energizing the induction coil so that the quantity of metal is heated to at least its melting point, thereby causing impurities within the quantity of metal to migrate toward the surface of the quantity of metal. When the molten metal passes through the opening in the support, a rim of solid metal having a relatively large proportion of impurities than the rest of the quantity of metal remains on the surface of the support, thereby purifying the quantity of metal that has passed through the opening in the support.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
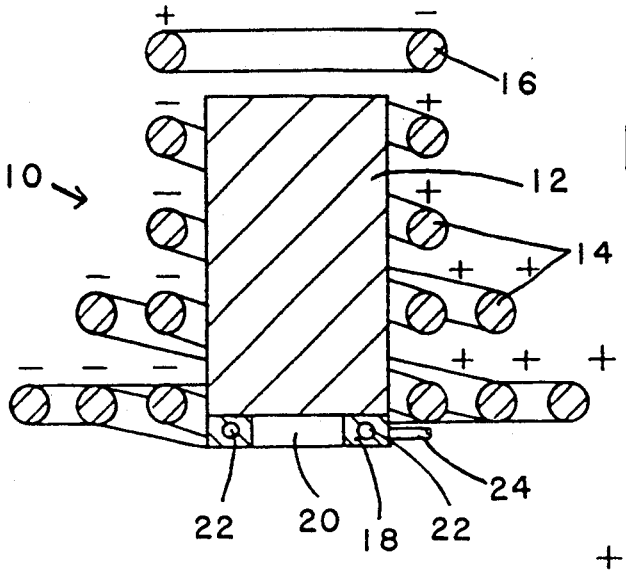
FIG. 1 is a schematic view of a charge of solid metal placed within the induction coil of the present invention and supported by a support.

FIG. 1 is a schematic view of the induction furnace of the present invention. A charge 12 of solid metal is located within an induction coil 10 having a plurality of turns 14. When energized in known manner, coil 10 generates a magnetic field which induces eddy currents within charge 12, thereby heating it. The general principles of induction heating and melting are well-known and need not be described here in detail.

Coil 10 also generates an electromagnetic force on charge 12 when coil 10 is energized. Turns 14 are arranged so that the electromagnetic force they produce will be concentrated toward the lower portion of the charge 12. In the preferred embodiment, the lower coils are doubled, tripled, or otherwise multiplied toward the bottom of the coil. Alternatively, the turns 14 could be arranged so that the turns toward the bottom of the charge 12 are closer to the charge 12 than the upper turns. Another alternative is to provide a plurality of separate power supplies, each corresponding to a different portion of the charge 12 and coil 14, so that the lower turns have more electrical energy associated with them.

The charge 12, before it is melted, rests on a support 18, which includes an opening 20 therethrough. Support 18 is illustrated as an annular ring, but it need not be annular. However, it is preferable that opening 20 be circular. Support 18 includes means for maintaining a preselected temperature, relatively cold compared to the charge 12 as it is melted. A typical means for cooling support 18 comprises internal cavities 22 through which a liquid coolant, supplied by tube 24, circulates. A preferred material for support 18 is copper.

The topmost turn 16 of the induction coil 10 is wound in a direction opposite that of the other turns 14 of the induction coil. This reverse turn has the effect of preventing the charge 12 from partially levitating or haystacking. If the metal were to be partially levitated, the excess surface area created by the partial levitation would be a source of heat loss by radiation, which would decrease the melting efficiency of the coil. This type of coil in which the upward levitation force is counteracted by a force in the opposite direction from the top of the coil is known as a "confinement" coil, as opposed to a levitation coil as disclosed in U.S. Pat. Nos. 2,686,864 or 4,578,552. If necessary, more than one of the upper turns of the induction coil may be effectively wound in the direction opposite the remaining turns in the coil, in order to provide a sufficient downward confinement force to counteract the upward levitation force of the rest of the turns in the coil. Levitation may also be prevented by the use of a suitably designed passive inductor such as a disc, ring, or similar structure located above charge 12 which suppresses the levitation forces.

The solid charge 12 is placed within the coil 10 in direct proximity to, but out of physical contact with, the turns 14. It should be emphasized that no crucible is used. The coil turns 14 are arranged so that the magnetic force that is generated supports the metal as it is melted and confines it to a cylindrical volume concentric with the center of the coil, while levitation of the melt is prevented by the arrangement described above.

Figure 2:
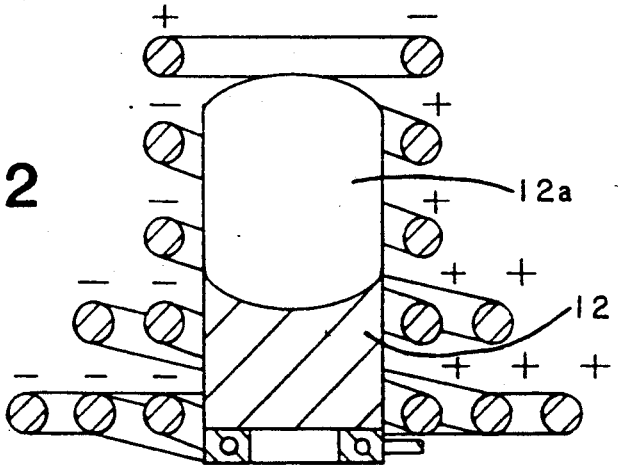
FIGS. 2 and 3 show subsequent steps of the melting of the charge in the induction coil. In these figures solid metal is represented by cross-hatching.
Figure 3:
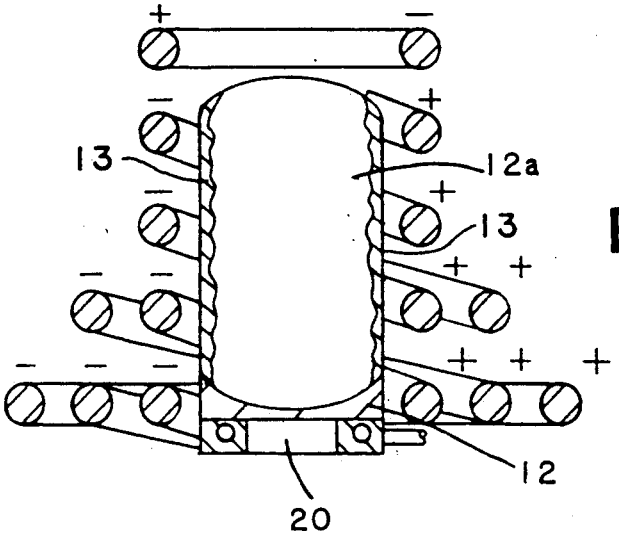

When power is applied to the coil 10, the metal begins to melt from the top of the charge (solid metal 12 is shown cross-hatched, and liquid metal **12*a* is shown stippled) as shown in FIG. 2. As melting proceeds, as shown in FIG. 3, the liquid portion 12*a* increases and moves down the charge. Because of the high magnetic forces provided by the extra turns at the base of the induction coil 10, the liquid portion 12*a* does not run over the sides of the charge 12 but remains confined to the original space occupied by the solid charge 12**.

Figure 4:
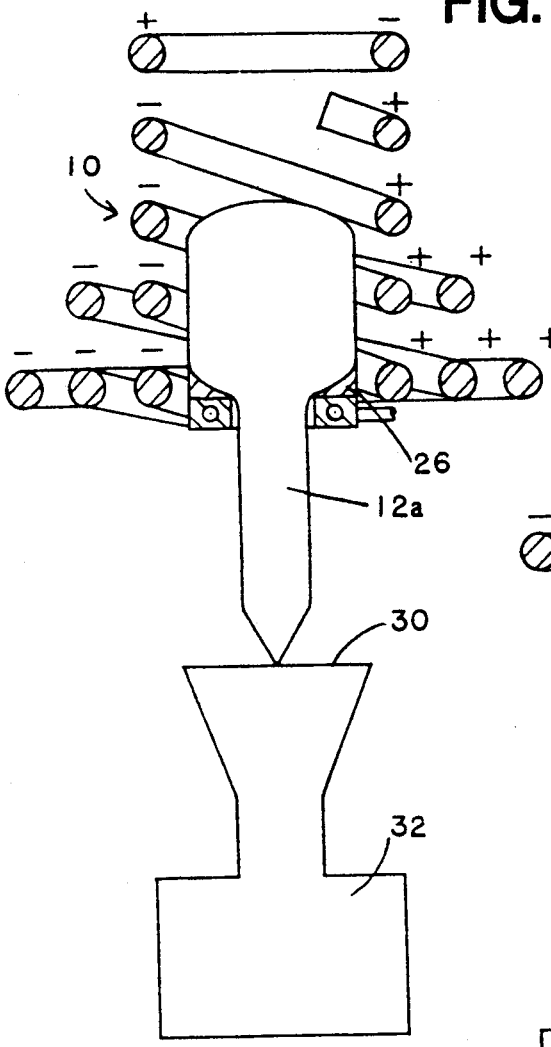
FIG. 4 is a schematic view of the molten metal within the induction coil of the present invention being poured into a casting mold.

Finally the heat transfer from the liquid metal **12*a* to the remaining solid charge 12 melts all of the charge 12 except for a rim of metal which rests directly on the support 18. When the portion of the solid charge 12 adjacent to opening 20 finally melts through, the liquid metal will pass through opening 20 and will fall into the opening 30 of casting mold 32, or some other container. The charge 12 may be sized so as to have the same volume as casting mold 32. Because support 18** is kept at a relatively low temperature by the cooling means of tube 24 and internal cavities 22, the metal in close proximity to support 18, designated 26 in FIG. 4, will remain solid.

The induction melting method of the present invention has been found to have the additional advantage of removing slag and other impurities for the metal charge 12 as the charge 12 melts and the molten metal 12*a* passes through opening 20. In the course of the induction melting of the charge 12, a quantity of slag and impurities tends to migrate to the surface of the molten charge 12*a*. This quantity of slag shown as shaded area 13 in FIG. 3. Because the opening 20 is preferably disposed along the axis of the cylindrical charge 12, the opening 20 is spaced from the zone of slag 13. Thus, when the liquid portion 12*a* breaks through the bottom of the solid charge 12 and passes through the opening 20, the concentrated slag 13 tends to settle along the outer perimeter of the support 18. The metal in close proximity to support 18, which cools against the surface of support 18 when most of the molten metal 12*a* pours out through opening 20, is therefore composed mostly of slag and other impurities. This quantity of metal, shown as 26 in FIG. 4, will not enter the mold 32. The method of the present invention thus has the effect of further purifying the metal charge 12 as it is poured into the mold 32.

It should be repeated that the purpose of the field which is supplied by the extra coil turns 14 towards the lower portion of the charge 12 is to confine the liquid charge 12*a* to the space within the coil 10 and to provide strong forced convective flow within the liquid charge, and not to levitate it or support its weight. The weight of the liquid metal 12*a* is supported by the solid metal 12 remaining unmelted at the bottom of the charge, until the proper pouring temperature has been obtained. Because the force needed to confine the liquid charge 12*a* is a function only of the height and density of the metal, increased charge weights may be melted merely by increasing the diameter of the charge and support ring.

In induction melting, it is occasionally necessary to provide liquid metal in a narrow temperature range, or to superheat the metal; that is, heat it to a temperature in excess of its melting point. By placing the charge 12 only partially within the coil 10, the portion of the charge 12 within the coil may be superheated without melting the bottom portion of the charge 12 and causing the liquid metal to pass through opening 20 prematurely. Only when the liquid metal 12*a* is at its desired temperature is the charge placed entirely within the coil 10; then, melting of the remaining charge is rapid and the molten alloy 12*a*, at the desired temperature, runs into the waiting casting mold.

Figure 5:
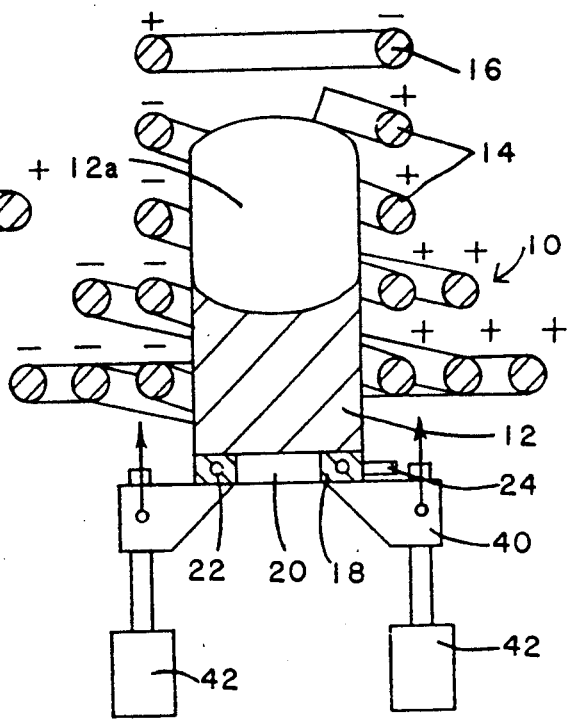
FIG. 5 is a schematic view of an alternate embodiment of the present invention, wherein the charge to be melted is mounted on a platform movable relative to the induction coil.

This accurate control of the melting process may be achieved by the embodiment shown in FIG. 5. Here the support ring 18 is attached to a lifting device comprising a vertically movable platform 40, which in turn is mounted on pylons 42. The lifting device may be actuated by pneumatic, hydraulic, mechanical, electrical, or other means. As charge 12 starts to melt, the charge 12 and support ring 18 are positioned somewhat below the induction melting coil 10, so that the lower part of the charge 12 is not affected by the induction field. In this lower position, only the top portion of charge 12 will be melted within the coil 10. When the molten portion at the top of charge 12 reaches the desired pouring temperature, the lifting device is actuated and raises the charge fully into the induction coil. Melting of the remaining portion of the charge is rapid, and the molten alloy 12*a*, at the desired temperature, runs into the waiting casting mold. For accurate control of the melting process, what is necessary is to provide relative movement between the charge 12 and the coil 10. The charge may be movable relative to a fixed coil, as in FIG. 5, or the coil may be movable relative to a fixed solid charge.

Figure 6:
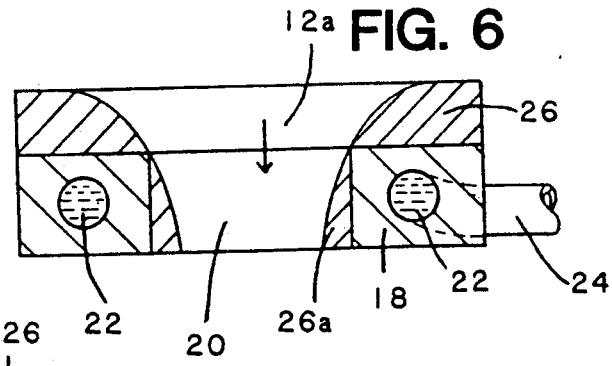
FIGS. 6 and 7 are detailed views of the support.

The outflow of molten metal through opening 20 in support 18 is illustrated in greater detail in FIG. 6. As previously described, support 18 is kept at a temperature lower than the melting point of the charge being melted, for example, by circulating a cooling fluid through passages 22 in support 18. Because support 18 is kept at a temperature below the melting point of the charge, a small amount of charge 12 will remain solid and will form an annular rim 26 which overlies and is concentric with support 18. In addition, once charge 12 melts through and molten metal begins to flow through opening 20, some metal 26*a* will freeze on the inner surface of opening 20.

In normal operation, it is expected that the "hole" melted in the bottom of the charge 12 will not be larger than the diameter of opening 20. In normal operation, therefore, there will always be a quantity of solid metal that surrounds support 18, so that the molten metal never comes into physical contact with support 18. However, that may not always be the case.

Figure 7:
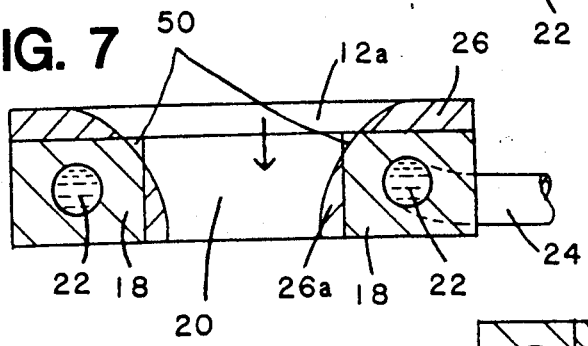

FIG. 7 shows what happens when the "hole" melted in the bottom of the charge is larger than the diameter of opening 20. In that case, annular rim 26 will not overlie the entire top surface of support 18 but will be recessed from the edge of opening 20, leaving a sharp edge 50 of support 18 exposed. This means that molten metal flowing through opening 20 will come into contact with support 18, and will become contaminated by the contact with it. The sharp edge 50 may also be melted by the molten metal flowing through opening 20, contaminating the melt to such a degree that the resulting casting may be unusable.

Figure 8:
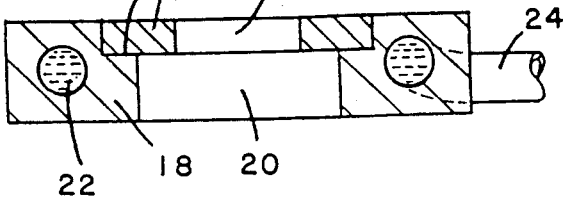
FIG. 8 shows an alternate embodiment of a support of the present invention.

In order to remedy this problem, a melt ring 52 with an opening 54 therethrough can be used, as shown in FIG. 8. The melt ring 52 is mounted around the top edge of the opening 20 in support 18. Support 18 may be provided with a step 19 on which the melt ring 52 can be supported. Melt ring 52 is made of a material identical to that of the charge 12. Opening 54 is smaller than opening 20 so that even if the hole of liquid metal in annular ring 26 is larger than opening 54, the liquid metal 12*a* will not erode melt ring 52 as far back as support 18. The idea is that the molten metal 12*a*, instead of melting the top edge of opening 20, will melt the melt ring 52. However, since the molten metal 12*a* is of an identical material as melt ring 52, molten metal from melt ring 52 will not contaminate molten metal 12*a* as it passes through the support 18.

The process described above avoids crucible contamination and reaction by eliminating the crucible entirely from the melting process. Also, because of the strong convection current established in the liquid metal by the electromagnetic forces, the liquid will be exceptionally homogeneous.

Figure 9:
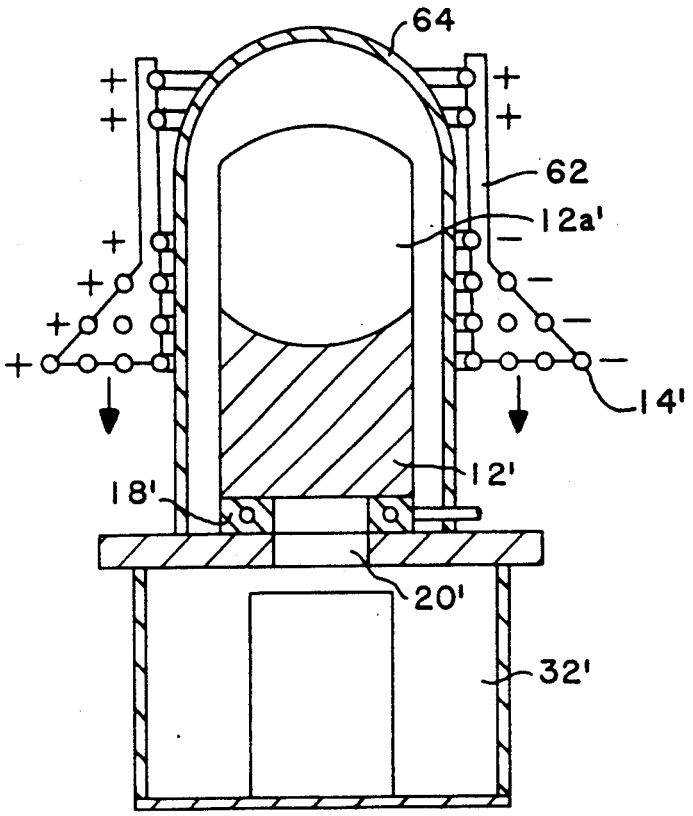
FIGS. 9 and 10 show alternate embodiments of the present invention.

The method of the present invention may be used in ambient air, in a vacuum or under high pressure, or in a controlled atmosphere. FIG. 9 shows a preferred embodiment of the present invention, wherein the metal charge 12′ and the support 18′ are stationary and the coil 14′ is movable relative to the charge 12′. The charge 12′ is disposed within a chamber 64, while the coil 14' is disposed on movable means 62 outside of the chamber 64. Chamber 64, which may be in the form of a glass bell jar or other sealed container, facilitates a controlled atmosphere around the metal charge 12' as it melts. The chamber 64 may enclose a volume of controlled atmosphere either within the coil 14', as shown in FIG. 9, or alternatively may envelop the coil 14' and mold 32' as well. It should be noted that, whatever the configuration of the chamber 64, the walls of the chamber 64 generally do not contact or act as a container for the metal charge 12'. The usual necessity for a controlled atmosphere is to prevent oxidation of the metal charge as it melts, and therefore chamber 64 would generally be either evacuated or pressurized with an inert gas such as argon, although it may be pressurized with any gas depending on specific needs.

The coil 14' is adapted to move relative to the melting charge 12' so that the topmost portion of the charge 12 may be quickly melted, as in the embodiment shown in FIG. 5 above, and superheated if desired. When the molten portion at the top of charge 12 reaches a desired temperature (which in the case of superheating may be well in excess of the metal's melting point), the coil 14' is moved downward relative to charge 12' to heat the remainder of the metal charge 12'. As in the above embodiment, wherein the support is movable, once melting has begun, melting of the remaining portion of the charge 12' is rapid, and the fully molten charge runs through the opening 20' in support 18', into a waiting casting mold. The casting mold may further include vacuum means whereby the rate of flow of molten metal into the mold may be controlled, or induction susceptor heating means, whereby the metal alloy in the mold may be maintained in a liquid state until the mold is completely filled.

Figure 10:
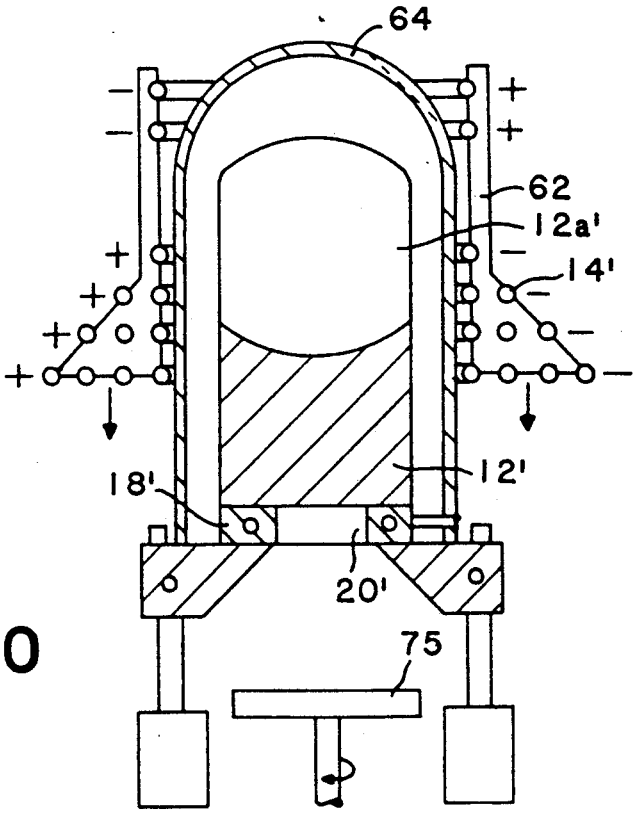

Of course, the movable coil 14' may be used without the sealed chamber 64 shown in FIGS. 9 and 10.

In addition to pouring molten metal into a mold, any embodiment of the present invention may be used in conjunction with a means for forming the molten metal into a powder. One apparatus for forming a powder is shown in FIG. 10. The preferred method of forming a powder from the molten metal is to allow the molten metal to pass through the opening 20 in support 18 and land on a rapidly spinning disk, shown for example as 75 in FIG. 10. When the molten metal lands on the disk, the molten metal is cast off the disk in the form of small droplets. These droplets cool and thus solidify as they are cast from the disk. By the time the droplets of molten metal land in a suitable receptacle, the droplets have cooled and hardened to form fine particles.

It has been found that the present invention has great utility in casting active metals such as alloys of aluminum, lithium, or titanium. It has further been found, in the casting of aluminum alloys with the melting apparatus of the present invention, castings having a much finer grain size are achieved compared with conventional methods.

The method of the present invention lends itself to automatic production quite readily, as no separate pouring operation is required. Where the proper pouring temperature is achieved without the use of a lifting device such as that shown in FIG. 5 or a movable coil as in FIGS. 9 or 10, pouring will take place when the requisite amount of energy for melting the bottom of the charge has been transferred to the charge. By adding an optical or infrared temperature measuring device, a control circuit can be designed so that, when superheat control is desired, the signal from the temperature measuring device can activate the means for moving the coil or support as well as control the power supply.

The present invention eliminates the need for and use of crucibles. Therefore, it completely eliminates reactions between the metallic charge and the crucible, as well as the contamination of the metal by the crucible or its reaction products. It also eliminates the expense of purchasing, storing, handling, and disposing of crucibles. Because there is no danger of reaction with the crucible, the present invention allows reproducible control of super-heating liquid metals in an automatic melting and pouring process. The present invention is far more energy efficient than cooled-crucible melting processes, as no energy is lost from the melt to the cooled crucible walls. It is also far more energy efficient than levitation, as no energy is spent suspending the metal. It has been found that the apparatus of the present invention can melt charges of masses up to ten times that of the Birlec process and its derivatives.

The present invention may be embodied in other specific forms without departing from the spirit or essential attributes thereof and, accordingly, reference should be made to the appended claims, rather than to the foregoing specifications, as indicating the scope of the invention.

We claim:

1. Apparatus for inductively melting a quantity of metal without a container, comprising:

an induction coil having a plurality of turns defining a volume for receiving the quantity of metal, the induction coil being adapted to exert an electromagnetic force on the metal which is greater toward the bottom of the coil than toward the top of the coil and including at least one turn toward the top of the induction coil being wound in a direction opposite that of at least the rest of the turns of the induction coil;

means for energizing the coil;

means for moving the coil along a longitudinal axis thereof relative to the quantity of metal received in said coil volume;

support means for supporting the metal from below and having an opening therethrough; and means for maintaining the support means at a preselected temperature.

2. Apparatus as in claim 1, further comprising a casting mold having an inlet opening in communication with the opening in the support means.

3. Apparatus as in claim 1, further comprising a rotatable disk adjacent the opening in the support means and positioned so that molten metal passing through the opening in the support means lands on the disk.

4. Apparatus as in claim 1, further comprising:

a sealed chamber enveloping the coil volume for receiving the quantity of metal, and means for controlling the atmosphere in the chamber.

5. A method of inductively melting a quantity of metal without a container, comprising the steps of:

placing the quantity of metal on a surface of a support having an opening therethrough;

placing an induction coil around the top portion of the quantity of metal, the induction coil being adapted to exert when energized an electromagnetic force which is stronger toward the bottom of the coil than toward the top of the coil;

energizing the induction coil, so that the portion of the quantity of metal disposed within the induction coil is heated to a preselected temperature;

lowering the induction coil so that substantially all of the quantity of metal is disposed within the induction coil; and further melting the quantity of metal so that the liquid, metal flows through the opening in the support.

6. A method as in claim 5, wherein the support includes means for maintaining the surface of the support at a preselected temperature below the melting point of the metal.

7. A method as in claim 5 further comprising the step of placing the quantity of metal within a sealed chamber having means for controlling the atmosphere therein.

8. A method as in claim 5, wherein the induction coil includes means for preventing the levitation of the quantity of metal.

9. A method as in claim 8, wherein the at least one of the turns of the induction coil toward the top of the induction coil is wound in a direction opposite that of the remainder of the turns of the induction coil.

10. A method of inductively melting a quantity of metal, and removing impurities therefrom, without a container, comprising the steps of:

placing the quantity of metal within an induction coil, the induction coil being adapted to exert when energized an electromagnetic force which is stronger toward the bottom of the coil than toward the top of the coil and further placing the quantity of metal on a surface of a support including means for maintaining the surface of the support at a preselected temperature below the melting point of the metal, the support also having an opening therethrough;

energizing the induction coil, so that the quantity of metal is heated to at least its melting point, thereby causing impurities within the quantity of metal to migrate toward the surface of the quantity of metal;

inductively melting the quantity of metal except for a rim of solid metal in contact with the support, the rim of solid metal having a relatively larger proportion of impurities than the remainder of the quantity of metal because of the migration of impurities toward the surface of the quantity of metal; and further melting the quantity of metal so that the liquid part of the quantity of metal flows through an opening in the rim of solid metal and the opening in the support.

11. A method as in claim 10 further comprising the steps of placing the quantity of metal partially within the induction coil until the portion of the quantity of metal within the electromagnetic field reaches a preselected temperature, and then placing the entire quantity of metal within the induction coil.

12. A method as in claim 10, further comprising the step of placing the quantity of metal as it is melted within a sealed chamber having means for controlling the atmosphere therein.

* * * * *

UNITED STATES PATENT AND TRADEMARK OFFICE

CERTIFICATE OF CORRECTION

PATENT NO. : 5,033,948

DATED : July 23, 1991

INVENTOR(S) : Nagy H. El-Kaddah, Thomas S. Piwonka and John T. Berry

It is certified that error appears in the above-identified patent and that said Letters Patent is hereby corrected as shown below:

ON TITLE PAGE: line 6, after the Assignee designation delete "Sandvik Limited, West Midlands, England" and replace with --Inductotherm Corp., Rancocas, New Jersey 08073--.

Signed and Sealed this

Nineteenth Day of November, 1991

*Attest:*

*Attesting Officer*

HARRY F. MANBECK, JR.

*Commissioner of Patents and Trademarks*